US007341093B2

(12) United States Patent
Rivest

(10) Patent No.: US 7,341,093 B2
(45) Date of Patent: Mar. 11, 2008

(54) COPPER-BASED ALLOYS AND THEIR USE FOR INFILTRATION OF POWDER METAL PARTS

(75) Inventor: Paul Rivest, Carmel, IN (US)

(73) Assignee: LLC 2 Holdings Limited, LLC, Carmel, IN (US)

( * ) Notice: Subject to any disclaimer, the term of this patent is extended or adjusted under 35 U.S.C. 154(b) by 26 days.

(21) Appl. No.: 11/348,975

(22) Filed: Feb. 7, 2006

(65) Prior Publication Data

US 2006/0180251 A1 Aug. 17, 2006

Related U.S. Application Data

(60) Provisional application No. 60/652,333, filed on Feb. 11, 2005.

(51) Int. Cl.
*B22D 19/00* (2006.01)

(52) U.S. Cl. ..... 164/98; 164/100

(58) Field of Classification Search ..... 164/98, 164/100; 420/477; 428/567; 148/522, 332; 25/246

See application file for complete search history.

(56) References Cited

U.S. PATENT DOCUMENTS

| | | | | |
|---|---|---|---|---|
| 2,817,601 | A * | 12/1957 | Shigley | 427/367 |
| 3,429,696 | A * | 2/1969 | Werley | 420/477 |
| 3,619,170 | A * | 11/1971 | Fisher et al. | 75/252 |
| 3,829,295 | A | 8/1974 | Farmer et al. | |
| 3,960,554 | A * | 6/1976 | Gainer, Jr. | 419/27 |
| 4,003,715 | A * | 1/1977 | Cascone | 428/555 |
| 4,008,051 | A | 2/1977 | Cadle | |
| 4,168,162 | A | 9/1979 | Shafer | |
| 4,412,873 | A | 11/1983 | Hone et al. | |
| 4,424,953 | A | 1/1984 | Takagi et al. | |
| 4,485,147 | A | 11/1984 | Nishino et al. | |
| 4,606,768 | A | 8/1986 | Svilar et al. | |
| 4,731,118 | A | 3/1988 | Svilar et al. | |
| 4,734,968 | A | 4/1988 | Kuroishi et al. | |
| 4,769,071 | A | 9/1988 | Klar et al. | |
| 4,822,560 | A | 4/1989 | Oyama et al. | |
| 4,861,373 | A | 8/1989 | Klar et al. | |
| 4,976,778 | A | 12/1990 | Berry et al. | |
| 5,031,878 | A | 7/1991 | Ishikawa et al. | |
| 5,062,908 | A | 11/1991 | Purnell et al. | |
| 5,574,959 | A | 11/1996 | Tsujioka et al. | |
| 5,925,836 | A | 7/1999 | Krause et al. | |
| 5,937,268 | A * | 8/1999 | Ozaki et al. | 428/552 |
| 6,551,373 | B2 | 4/2003 | Alcini et al. | |
| 6,610,244 | B2 | 8/2003 | Dollmeier et al. | |
| 6,676,894 | B2 | 1/2004 | Alcini | |

FOREIGN PATENT DOCUMENTS

| | | |
|---|---|---|
| WO | WO 2005/077571 | 8/2005 |

* cited by examiner

*Primary Examiner*—Jonathan Johnson
*Assistant Examiner*—I.-H. Lin
(74) *Attorney, Agent, or Firm*—Woodard, Emhardt, Moriarty, McNett & Henry LLP

(57) ABSTRACT

Described are wrought forms of copper alloys for infiltrating powder metal parts, the method for preparing the copper alloys and their wrought forms, the method for their infiltration into a powder metal part, and the infiltrated metal part infiltrated with the novel alloys having a generally uniform distribution of copper throughout and exhibiting high transverse rupture strength, tensile strength and yield strength. Infiltrated metal parts prepared by infiltrating powder metal parts with reduced amounts of the novel infiltrant typically weigh less and have superior strengths compared to similarly prepared infiltrated metal parts prepared with standard methods and conventional infiltration.

13 Claims, 8 Drawing Sheets

COPPER-BASED ALLOYS AND THEIR USE FOR INFILTRATION OF POWDER METAL PARTS

CROSS-REFERENCE TO RELATED APPLICATION

The present application claims priority to U.S. Provisional Patent Application Ser. No. 60/652,333 filed on Feb. 11, 2005, which is hereby incorporated by reference in its entirety.

BACKGROUND

The present disclosure relates to the manufacture and use of metal alloys, and in particular, to the use of metal alloys to infiltrate powder metal parts. Metal powder can be used to economically form a variety of complex-shaped metallic components or compacts by using a pressing and sintering process. Use of this method provides a powder metal part in near net shape, i.e., in the final desired size and shape, with minimal or no machining required. However, the resulting powder metal parts are loosely held together and exhibit relatively low impact and fatigue strength. These properties can be improved by infiltrating the parts with infiltrants that are typically copper based powders that may contain optional components such as, for example, lubricants and graphite. The infiltrant powder infiltrates the porous structure of the powder metal parts during the sintering process. The infiltrant powders are typically a mixture of copper and one or more additional metals.

The infiltration process for a copper-based infiltrant generally begins by placing the copper-based powder infiltrant in contact with the pressed and/or sintered powder metal part and subjecting this combination to a heating process which melts the copper-based powder. As the infiltrant powder melts, the molten material flows into the compact's pores. Components of the infiltrant can melt and diffuse into the compact at different rates. As a result, the distribution of copper throughout the infiltrated powder metal part can vary. Infiltrated articles having an uneven distribution of copper are more subject to rupture when subjected to a variety of forces.

Typically, a supplier or user of the infiltrant will press the infiltrant powder into a particular shape, such as a hollow cylinder, briquette, or pellet, to facilitate handling, shipping and/or storage, and to maximize its surface area that is in contact with the article being infiltrated. In these various forms the pressed infiltrant compacts can then be transported and utilized in a variety of infiltration processes. However, these pressed infiltrant compacts remain fragile and subject to breakage during their shipment and handling. This breakage increases waste and handling costs as well as environmental costs incurred to manage the resulting infiltrant particles or dust that can become suspended in the air and ultimately settle on work-surfaces. Workers must be protected from inhalation of this dust, so its removal from the workplace is necessary. Therefore, in light of the above, improved infiltrants and methods for their incorporation into powder metal parts are needed. Such improved infiltrants and methods for their use should avoid a majority of the disadvantages of the infiltrating powders described above. Particularly, such improved infiltrants should not be subject to breakage and powdering, should melt within a generally narrow temperature range, upon infiltration into a powder metal compact, provide generally uniform copper levels and impart strength to infiltrated article sufficient for its intended use. The present disclosure addresses these needs.

SUMMARY

One aspect of the disclosure provides a method for infiltrating a powder metal part with a wrought form of a metal alloy. The process can include selecting the powder metal part, selecting the metal alloy having a wrought form adapted to contact a portion of the surface of the powder metal part, contacting the surface of the metal part with the alloy and heating the alloy to a temperature sufficient to cause the alloy to melt and infiltrate the powder metal part.

A variety of powder metal parts are suitable for infiltration with the novel alloy provided its components melt at a temperature higher than the alloy. In addition to the conventional iron-based powder metal parts, powder metal parts can also be based on a variety of other materials including, but not limited to stainless steel, nickel based alloys, cobalt based alloys and systems comprising refractory metals. The term "powder metal part" is intended to broadly cover any powder metal part that can be infiltrated with a copper-based alloy to form a more dense metal part.

In one embodiment, the metal alloy comprises copper, iron, and, optionally, manganese, and zinc, with copper being the major component. In a preferred embodiment, the copper-based alloy includes at least about 85 weight % copper, about 0.5 to about 3.5 weight % iron, about 0.5 to about 5.5 weight % manganese, and about 0.5 to about 5.5 weight % zinc. The copper-based alloy can include minor amounts of various impurities or tramp elements without significantly affecting the processing parameters and/or the properties of the final infiltrated product.

The process of infiltration according to the present disclosure can include contacting the powder metal part with a wrought form of an alloy infiltrant; subjecting the combined components to a heat treatment, including either a one-step or a two stage process; and subjecting the hot infiltrated part to a cool down cycle to solidify the infiltrant. During the beat treatment the alloy is heated to a sufficiently high temperature to form a molten alloy that flows into the pores of the powder metal part. This process provides an infiltrated powder metal part that exhibits greater wear resistance and increased strength at lower infiltration levels compared to parts infiltrated by other known processes and with other known infiltrants. The process can be conducted in a variety of atmospheric conditions such as, for example, a vacuum or partial vacuum, or a highly-reducing atmosphere which can include nitrogen and/or hydrogen or an endothermic atmosphere.

In another aspect of the disclosure, an infiltrated metal part prepared according to the method of the disclosure exhibits a generally uniform distribution of copper throughout and improved mechanical properties which include, but are not limited to, increased transverse rupture strength, increased tensile strength, and increased yield strength, compared to a metal part infiltrated using a known infiltration method. The improved strengths are particularly noted at lower infiltration levels.

One further aspect of this disclosure includes the method for preparing an infiltration alloy in a form having a three-dimensional form. The method comprises forming a mixture containing at least about 85 weight % copper, about 0.5 to about 3.5 weight % iron, about 0.5 to about 5.5 weight % manganese, and about 0.5 to about 5.5 weight % zinc; heating the mixture to a temperature sufficient to form a homogeneous molten mass; transferring the molten mass into a three-dimensional form and solidifying said formed molten mass by cooling. Further objects, embodiments, forms, benefits, aspects, features and advantages of the disclosure may be obtained from the description, drawings, and claims provided herein.

DETAILED DESCRIPTION

The present disclosure relates to wrought forms of metal alloys, a method for preparing the alloys, a method for infiltrating a powder metal part with the metal alloy, and the infiltrated metal parts made by the novel process. The novel metal alloys are copper-based and typically contain in addition to copper, iron, zinc, and manganese, with the majority of the alloy being copper. To infiltrate a powder metal part or compact, the copper-based alloy is placed in contact with the part and the combination of the part and the alloy is subjected to a heat treatment to induce the alloy to melt, causing substantially all the molten alloy to flow into the part's pores. Upon cooling, the alloy within the infiltrated part solidifies providing a generally uniform distribution of copper throughout the powder metal part.

In a particular embodiment, the copper-based alloy has a nominal composition of about 0.5% to about 3.5% iron, about 0.5% to about 5.5% manganese, and about 0.5% to about 5.5% zinc, with the remainder (except for tramp elements) as copper. Preferred copper-based alloys typically contain at least 85% copper. Suitable alloys can tolerate a variety of tramp elements including, but not limited to, nickel, tin, silicon, phosphorous, lead, and aluminum, each tramp element typically in an amount of less than about 0.01% by weight, without experiencing deleterious effects to either the infiltration process or the resulting infiltrated part. By varying the relative amounts of the alloy's components, the alloy can be prepared to have a melting point suitable for use in an infiltration process, typically between about 950 to about 1150° C., thereby making it suitable for use in a variety of infiltration processes.

Figure 1:
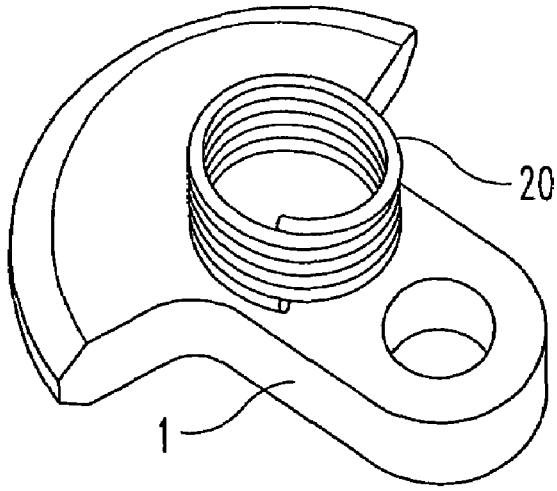
FIG. 1 is a perspective view of an exemplary powder metal part showing an alloy infiltrant in accordance with an aspect of the disclosure, illustratively shown in the shape of a flexible wire.
Figure 2:
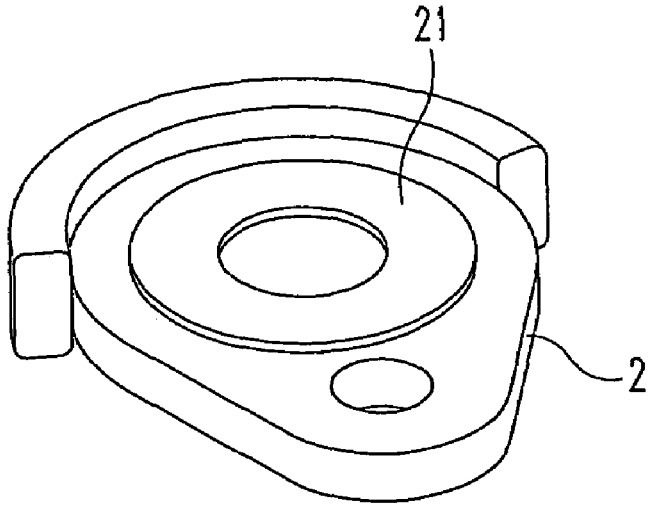
FIG. 2 is a perspective view of an exemplary powder metal part showing an alloy infiltrant in accordance with an aspect of the disclosure, illustratively shown in the form of a ring or washer.
Figure 3:
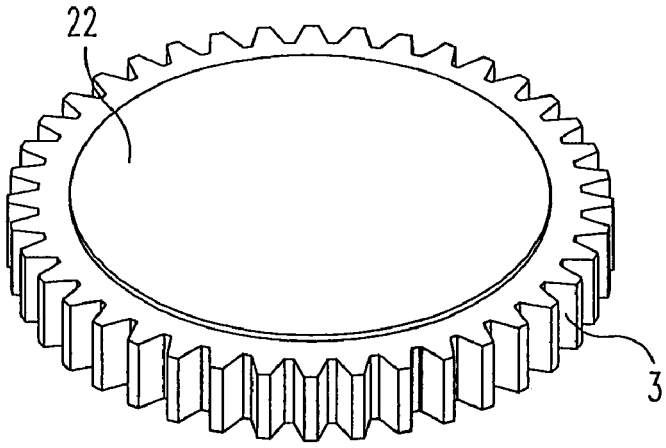
FIG. 3 is a perspective view of an exemplary powder metal part showing an alloy infiltrant in accordance with an aspect of the disclosure, illustratively shown in the form of a disk.
Figure 4:
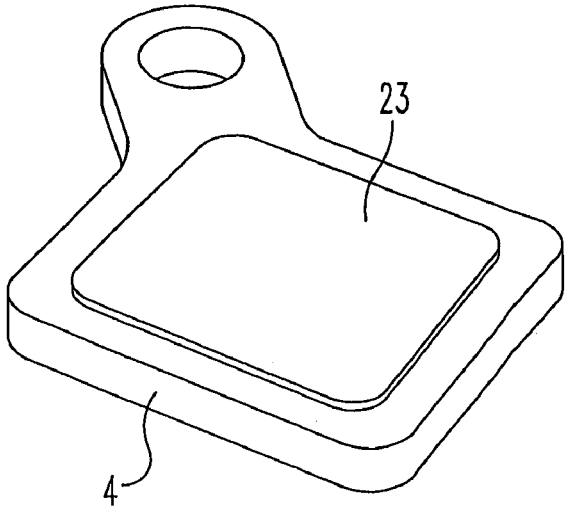
FIG. 4 is a perspective view of an exemplary powder metal part showing an alloy infiltrant in accordance with an aspect of the disclosure, illustratively shown in the form of a wafer.

An infiltrant having a form suitable for use in accordance with the disclosure can be prepared by a variety of methods. In one embodiment, the alloy's components are combined, heated to a temperature sufficient to form a homogeneous molten mass which then is cast or molded to form a billet. Billets formed can be extruded or rolled to provide wrought forms including rods, tubes, sheets, and the like. An extruded alloy can also be divided into segments or further processed by standard drawing methods to form flexible wires. The wrought forms of the novel alloy have a uniform composition and can be provided in or conformed into a variety of forms and/or shapes advantageous for use in an infiltration process. In one embodiment, the copper based infiltrant is provided in the form of a drawn wire that can be wound onto spools for efficient handling. Segments of the wire can be removed in an appropriate amount and conformed to a shape appropriate for use in a particular infiltration process. FIG. 1 illustrates a segment of wire 20 adapted to conform to the surface of powder metal part 1 prior to infiltration. In an infiltration process involving the infiltration of large numbers of parts having a known size and shape, the alloy may be provided in forms that include disks, washers, wafers, sheets, rings and other shape suitable for a particular application. FIGS. 2, 3 and 4 illustrate a ring or washer 21, a disk 22 and a wafer 23, adapted to conform to the surface of powder metal parts 2, 3, and 4, respectively. As illustrated, each of these wrought forms of a washer or a disk should be sized for the part to be infiltrated when formed, whereas alloy material in wire or wafer form can be sized and conformed to the desired shape at any time prior to the infiltration process.

Although powder metal parts suitable for infiltration can be prepared from a variety of metal powders, iron-base metal parts are more commonly used. Such powder metal parts, referred to as green parts, are typically prepared by known pressing or molding techniques and may be sintered or unsintered. The alloy infiltrant is then typically placed in contact with the powder metal part. The combined components are then subjected to a heat treatment. Although contact with the powder metal part is commonly with a solid infiltrant, contact can also occur with molten infiltrant. For example, by maintaining the infiltrant above the powder metal part during the heating process, infiltrant contact can be delayed and limited to contact with only molten infiltrant alloy formed during the heating process. A variety of means can be envisioned to maintain the infiltrant alloy over the powder metal part, depending on the infiltrant's size and shape. The heat treatment can be one or more stages with an optional cool down cycle. Preferably, the heat process is done in a reducing atmosphere and/or under partial vacuum.

In one form, the process involves contacting the powder metal part with the alloy infiltrant. The combined parts are then subjected to a single-stage heat treatment which includes gradually heating the combined part and alloy infiltrant in a furnace under a reducing atmosphere at a temperature of between about 950° C. (1750° F.) to about 1150° C. (2100° F.) until the alloy is molten or liquid. The combined parts are subjected to the heat treatment for a time period sufficient to allow infiltration of the molten alloy into the pores in the green powder metal part. In certain embodiments, this time period can range between about 2 minutes to about 90 minutes. The amount of infiltrant, the temperature and/or the time of the process can be adjusted as desired to provide parts having a range of infiltrant densities up to a uniform density throughout the powder metal part.

For a two-stage heat treatment, the powder metal part is first treated to a high temperature sintering process. The high temperature process subjects the powder metal part to a temperature range between about 950° C. (1750° F.) to about 1150° C. (2100° F.) for a time period ranging between about 5 minutes to about 40 minutes. Thereafter, the powder metal part and infiltrant alloy can then be recycled through the same furnace under different conditions or sent directly to a second furnace. The second heat treatment can include sintering the combined parts. This process can be performed at a temperature between about 950° C. (1750° F.) to about 1150° C. (2100° F.) for a time period between about 5 minutes and about 90 minutes. In particular embodiments, both the first and second stage heat treatments are performed under a reducing atmosphere and/or under a partial vacuum. After the parts have undergone this infiltration treatment, the infiltrated metal part can then be allowed to cool down in a cool-down cycle.

The infiltrant and infiltration processes according to the present disclosure offer particular advantages. For example, the copper-based powder infiltrants composed of a mixture of components are subject to particle segregation that can result in composition differences from sample to sample. Additionally, the different powder components can melt and infiltrate at different rates and/or temperatures. Unlike the copper-based powder infiltrants, the wrought infiltrant is has a uniform composition that remains constant from sample to sample. Further, the wrought alloy melts and infiltrates uniformly. Additionally, the preferred process can be performed without the necessity of an infiltrant lubricant, such as, for example, metallic stearate or synthetic wax, yet still permits essentially complete infiltrant densification of the powder metal part, i.e., an infiltrated density approaching 100% when desired. It should be understood by those skilled in the art that the processes can be modified to fabricate an infiltrated powder metal part or compact having a range of desired infiltrant density, such as for example, a density between 85% and 99%.

This infiltration process can provide infiltrated articles that change very little in shape as a result of the infiltration process, yet are essentially 100% infiltrated, i.e., greater than 98% of infiltrated density. Alternatively, by varying the conditions (e.g., the temperature ranges, the time period for the heat treatment, and/or the amount of copper in the infiltrant), varying degrees of infiltrated density can be afforded to the powder metal part. Therefore, under a judicious selection of process conditions and amount of the copper-based alloy infiltrant, a final infiltrated metal part can be provided to have an infiltrated density between about 85% and about 98%+dense. Depending on the powder metal part's porosity, the weight of the powder metal article can be increased by an amount between about 8 wt % and 20 wt % using a copper base alloy infiltrant in accordance with the disclosure. Because the zinc component of the alloy is more volatile than the other components, an infiltrated powder metal part infiltrated with a copper alloy according to the present disclosure can, depending on the infiltration conditions, contain reduced levels of zinc, without affecting the metal part's performance.

The process according to the disclosure can provide an infiltrated material with extremely high infiltration efficiency and productivity, eliminating secondary operations commonly associated with infiltration processes. The high infiltration efficiency reduces the amount of loss of the infiltrant material, reduces processing costs, and minimizes cleanup costs and EPA/OSHA concerns. Furthermore, applicant's method utilizes infiltrants that require no compaction tooling and are easy to handle, produces infiltrated articles that exhibit increased density, are generally free from erosion and residue from the infiltrant, and typically exhibit superior properties. These superior properties generally include, for example: 1) generally uniform copper distribution, 2) increased transverse rupture strength, 3) increased tensile strength, 4) increased yield strength, and 5) increased strength indices.

The strength indices are derived from the ratio of a particular strength divided by the density of the infiltrated article. For example, the formula for the transverse rupture strength (TRS) index is:

$$TRS\ \text{Index} = \frac{TRS\ (psi)}{\text{density (g/cm}^3) \times 10^4\ \text{(scaling factor)}} \qquad \text{(Equation 1)}$$

The Tensile Strength (TS) Index and the Yield Strength (YS) Index can be calculated from this formula by substituting the Tensile Strength and the Yield Strength for the Transverse Rupture Strength. A strength index provides information about the level of strength achieved with a unit mass of metal and is independent of a standard article. Maximizing the strength of an article without increasing its weight is an important objective in designing equipment that is lightweight and easy to handle, as in the case of fuel efficient motor vehicles. A modified strength index (SI*) can additionally reflect both the density of the infiltrated article and the % infiltration. The Modified strength Index can be calculated from the formula:

$$\text{Modified } TRS \text{ Index } (SI^*) = \frac{TRS(psi)}{\text{density (g/cm}^3) \times (\%\ \text{infiltration})^4} \qquad \text{(Equation 2)}$$

The Modified Tensile Strength Index (TS SI*) and the Yield Strength Index (YS SI*) can be calculated from this formula by substituting the Tensile Strength and the Yield Strength for the Transverse Rupture Strength.

The present disclosure contemplates modifications as would occur to those skilled in the art. It is also contemplated that individual steps in the processes embodied in the present disclosure can be altered, deleted, duplicated, or added to other processes as would occur to those skilled in the art without departing from the spirit of the present disclosure. In addition, the various stages, techniques, and operations within these processes may be altered as would occur to those skilled in the art. Further, any theory of operation, proof, or finding stated herein is meant to further enhance understanding of the present disclosure and is not intended to make the scope of the present disclosure dependent upon such theory, proof, or finding.

The following examples illustrate some of the improved properties realized in accordance with particular embodiments of the disclosure.

EXAMPLE 1

Preparation of Raw Compacts for Infiltration

Un-sintered compacts for test specimens were prepared by compacting a powder mixture of Atomet 28 iron powder, 0.9 weight % graphite and 0.75 weight % Acrawax C lubricant. Atomet powder is available from Quebec Metal Powder Ltd., 1655 Route Marie-Victorin Tracy, Quebec Canada J3R 4R4 and Acrawax C lubricant is available from Lonza Inc., 3500 Trenton Ave. Williamsport, Pa. 17701. Acrawax is a registered trademark of Chas. L. Huisking & Co., Inc., 417 5$^{th}$ Ave. New York, N.Y. Porous compacts, 6-1 through 6-5 and 7-1 through 7-5 having a rectangular shape, nominally 1.25 inches long, 0.50 inches wide and 0.25 inches thick and densities of about 6.7 and 7.0 g/cm$^3$ were prepared for infiltration. As illustrated in Table I, the green compacts were measured prior to infiltration.

TABLE I

Raw Compacts - Atomet 28 Powder

| Sample ID | Density g/cm$^3$ | Width Inch(s) | Overall Length Inch(s) | Weight g |
|---|---|---|---|---|
| 6-1 | 6.67 | 0.5014 | 0.2435 | 16.671 |
| 6-2 | 6.65 | 0.5013 | 0.2367 | 16.158 |
| 6-3 | 6.68 | 0.5013 | 0.2351 | 16.126 |
| 6-4 | 6.68 | 0.5012 | 0.2381 | 16.348 |
| 6-5 | 6.67 | 0.5014 | 0.2427 | 16.625 |
| 7-1 | 6.93 | 0.5025 | 0.2509 | 17.896 |
| 7-2 | 6.96 | 0.5020 | 0.2510 | 17.955 |
| 7-3 | 6.95 | 0.5017 | 0.2556 | 18.260 |
| 7-4 | 6.97 | 0.5022 | 0.2524 | 18.090 |
| 7-5 | 6.96 | 0.5023 | 0.2477 | 17.737 |

EXAMPLE 2

Infiltration of Compacts

Individual sections of a wire alloy containing about 93% copper, about 3% manganese, about 3% zinc and about 1% iron were selected and readied for infiltration. Lengths of the wire alloy weighing about 2.4 g was placed on the top of each of samples 6-1 through 6-5 and samples 7-1 through 7-5 and the samples sintered at about 1125° C. for about 30 minutes under a 90/10 nitrogen/hydrogen atmosphere, then allowed to cool to ambient temperature. The resulting infiltrated compacts were re-measured as illustrated in Table II. Similar results can be obtained with segments of wire alloy having as little as about 85% copper.

TABLE II

Infiltration Data - A

| Sample ID | Infiltrate gm/% | Density g/cm$^3$ | Width Inch(s) | Overall Length Inch(s) | Weight g |
|---|---|---|---|---|---|
| 6-1 | 2.33/13.9 | 7.51 | 0.5008 | 0.2440 | 18.789 |
| 6-2 | 2.33/14.4 | 7.58 | 0.5006 | 0.2348 | 18.264 |
| 6-3 | 2.33/14.4 | 7.61 | 0.5007 | 0.2345 | 18.320 |
| 6-4 | 2.33/14.3 | 7.63 | 0.5014 | 0.2378 | 18.659 |
| 6-5 | 2.53/15.2 | 7.56 | 0.5015 | 0.2426 | 18.863 |
| 7-1 | 2.38/13.3 | 7.81 | 0.5019 | 0.2492 | 20.061 |
| 7-2 | 2.44/13.6 | 7.80 | 0.5021 | 0.2509 | 20.174 |
| 7-3 | 2.44/13.4 | 7.83 | 0.5025 | 0.2553 | 20.616 |
| 7-4 | 2.44/13.5 | 7.78 | 0.5022 | 0.2530 | 20.293 |
| 7-5 | 2.47/13.9 | 7.83 | 0.5020 | 0.2477 | 19.987 |

EXAMPLE 3

Determination of Transverse Rupture Strength and Hardness

The transverse rupture strength and hardness (HRB and HRC) of certain of the infiltrated compact samples were determined by the following methods: MPIF Standard Test Method #41 and MPIF Standard Test Method #43. The results obtained are provided in Table III.

TABLE III

Mechanical Strength - A

| Sample ID | % Infiltration | Density g/cm$^3$ | Transverse Rupture Strength Psi | SI | SI* | Hardness HRB | Hardness HRC |
|---|---|---|---|---|---|---|---|
| 6-2 | 14.4 | 7.58 | 225,400 | 2.98 | 0.71 | — | 23-17 |
| 6-4 | 14.3 | 7.63 | 197,100 | 2.58 | 0.65 | 102 | 25-19 |
| 6-5 | 15.2 | 7.56 | 224,500 | 2.97 | 0.57 | 101 | 24-16 |
| Average | 14.6 | 7.59 | 215,000 | 2.83 | 0.64 | 101.5 | 24-17 |
| 7-1 | 13.3 | 7.81 | 239,200 | 3.06 | 1.01 | — | 28-23 |
| 7-3 | 13.4 | 7.83 | 196,700 | 2.51 | 0.80 | — | 30-25 |
| 7-4 | 13.5 | 7.78 | 221,000 | 2.84 | 0.78 | 106 | 30-24 |
| Average | 13.4 | 7.81 | 219,000 | 2.80 | 0.87 | 106 | 29-24 |

EXAMPLE 4

Determination of Tensile Strength Yield Strength and % Elongation

Samples 6-6 through 6-10 and 7-6 through 7-10 were prepared as described above and sintered with 12.1% and 11.4% of the wire infiltrant, respectively. The samples were formed in the shape of flat tensile specimens. The tensile strength, yield strength and % elongation of each sample was determined by MPIF Standard Method #10. The results for samples 6-6 through 6-10 and 7-6 through 7-10 are provided in Table IV.

TABLE IV

Mechanical Strength - B

| Sample ID | Green Density g/cm$^3$ | Infiltrated Density g/cm$^3$ | Tensile Strength psi | SI | SI* | Yield Strength psi | SI | SI* | % Elongation |
|---|---|---|---|---|---|---|---|---|---|
| 6-6 | 6.7 | 7.45 | 115,000 | 1.54 | 0.72 | 85,000 | 1.14 | 0.53 | 2.7 |
| 6-7 | 6.7 | 7.44 | 116,000 | 1.56 | 0.73 | 90,000 | 1.21 | 0.57 | — |

TABLE IV-continued

Mechanical Strength - B

| Sample ID | Green Density g/cm³ | Infiltrated Density g/cm³ | Tensile Strength psi | Tensile Strength SI | Tensile Strength SI* | Yield Strength psi | Yield Strength SI | Yield Strength SI* | % Elongation |
|---|---|---|---|---|---|---|---|---|---|
| 6-8 | 6.7 | 7.43 | 107,000 | 1.44 | 0.67 | 84,500 | 1.14 | 0.53 | 2.8 |
| 6-9 | 6.7 | 7.45 | 114,000 | 1.53 | 0.72 | 86,500 | 1.16 | 0.54 | 2.7 |
| 6-10 | 6.7 | 7.44 | 116,000 | 1.56 | 0.73 | 86,500 | 1.16 | 0.54 | 2.7 |
| Average | 6.7 | 7.44 | 114,000 | 1.53 | 0.72 | 86,500 | 1.16 | 0.54 | 2.7 |
| 7-6 | 7.0 | 7.68 | 121,000 | 1.58 | 0.93 | 90,500 | 1.18 | 0.70 | 2.5 |
| 7-7 | 7.0 | 7.67 | 132,000 | 1.72 | 1.02 | 95,000 | 1.24 | 0.73 | 3.3 |
| 7-8 | 7.0 | 7.67 | 127,000 | 1.66 | 0.98 | 94,000 | 1.23 | 0.73 | — |
| 7-9 | 7.0 | 7.63 | 129,000 | 1.70 | 1.00 | 94,000 | 1.23 | 0.73 | 3.1 |
| 7-10 | 7.0 | 7.66 | 126,000 | 1.64 | 0.97 | 98,000 | 1.28 | 0.76 | 3.0 |
| Average | 7.0 | 7.66 | 127,000 | 1.66 | 0.98 | 94,300 | 1.23 | 0.73 | 3.0 |

EXAMPLE 5

Determination of Impact Energy

Samples 6-11 through 6-15 and 7-11 through 7-15 were prepared as described above and sintered with 13.4% and 12.9% of the wire infiltrant, respectively. The samples were formed in the shape of Izod impact energy test specimens (i.e., 75 mm in length, 10 mm in width and thickness). The Impact Energy of the infiltrated samples was determined by MPIF Standard Test Method #40. The results for samples 6-11 through 6-15, 7-11 through 7-15 are provided in Table V.

TABLE V

Infiltration Data - B

| Sample ID | Green Density g/cm³ | Infiltrated Density g/cm³ | Impact Energy ft-lbf |
|---|---|---|---|
| 6-11 | 6.7 | 7.60 | 10 |
| 6-12 | 6.7 | 7.56 | 13 |
| 6-13 | 6.7 | 7.59 | 12 |
| 6-14 | 6.7 | 7.59 | 12 |
| 6-15 | 6.7 | 7.57 | 10 |
| Average | 6.7 | 7.58 | 11.4 |

TABLE V-continued

Infiltration Data - B

| Sample ID | Green Density g/cm³ | Infiltrated Density g/cm³ | Impact Energy ft-lbf |
|---|---|---|---|
| 7-11 | 7.0 | 7.81 | 14 |
| 7-12 | 7.0 | 7.82 | 8.5 |
| 7-13 | 7.0 | 7.78 | 9 |
| 7-14 | 7.0 | 7.78 | 10 |
| 7-15 | 7.0 | 7.80 | 17 |
| Average | 7.0 | 7.80 | 11.7 |

EXAMPLE 6

Comparison of the Properties of Infiltrated Articles Using Different Infiltrants Summarized below in Table VI is a comparison of the mechanical strength of compacts infiltrated with the alloy (in wire form) of the present disclosure and a copper alloy in powder form. Summarized in Tables VII and VIII are tabulations illustrating the % increases in transverse rupture strength, tensile strength and yield strength achieved by the improved infiltration processes described above.

TABLE VI

Mechanical Strength - Summary and Comparison

| Material | Density g/cm³ | Tensile Strength psi | Yield Strength psi | % Elongation | Transverse Rupture Strength psi | Hardness HRB/HRC | Impact Energy ft-lbf |
|---|---|---|---|---|---|---|---|
| MPIF FX-1008* | 7.3 | 87,000 | 60,000 | 3 | 166,000 | 89 | 10 |
| Alloy in wire form** | 7.44-7.59 | 114,000 | 86,500 | 2.7 | 215,000 | 101/21 | 11.4 |
| Alloy in wire form** | 7.66-7.81 | 127,000 | 94,300 | 3 | 219,000 | 106/27 | 11.7 |

*The properties for MPIF FX-1008 were reproduced from "Materials Standards for P/M Structural Parts", page 23, (2003) published by Metal Powder Industries Federation, 105 College Road East, Princeton, New Jersey 08540-6692.

**The single values are average values from Tables III, IV, and V

Summarized below in Table VII are comparisons of the % increases in the transverse rupture strength, the tensile strength and the yield strength of powder metal compacts infiltrated with an alloy of the present disclosure (in wire form) and the known powder metal infiltrated steel MPIF FX-1008 (infiltrant in powder form) as well as the various strength indices (S.I.'s) for the samples.

TABLE VII

Strength Comparisons

| Sample ID | Transverse Rupture Strength % Increase | Transverse Rupture Strength S.I. | Tensile Strength, % Increase | Tensile Strength, S.I. | Yield Strength % Increase | Yield Strength S.I. |
|---|---|---|---|---|---|---|
| MPIF FX-1008 | 0 | 2.3 | 0 | 1.2 | 0 | 0.8 |
| 6-2 | 35.8 | 3.0 | — | — | — | — |
| 6-4 | 18.8 | 2.9 | — | — | — | — |
| 6-5 | 35.2 | 3.0 | — | — | — | — |
| 7-1 | 44.1 | 3.1 | — | — | — | — |
| 7-3 | 18.5 | 2.5 | — | — | — | — |
| 7-4 | 33.1 | 2.8 | — | — | — | — |
| Average | 30.9 | 2.9 | — | — | — | — |
| 6-6 | — | — | 17.2 | 1.5 | 41.7 | 1.1 |
| 6-7 | — | — | 33.3 | 1.6 | 50.0 | 1.2 |
| 6-8 | — | — | 22.9 | 1.4 | 40.8 | 1.1 |
| 6-9 | — | — | 31.0 | 1.5 | 44.2 | 1.2 |
| 6-10 | — | — | 33.3 | 1.6 | 44.2 | 1.2 |
| Average | — | — | 21.3 | 1.5 | 36.2 | 1.2 |
| 7-6 | — | — | 39.1 | 1.6 | 50.8 | 1.2 |
| 7-7 | — | — | 51.7 | 1.7 | 58.3 | 1.2 |
| 7-8 | — | — | 45.9 | 1.7 | 56.7 | 1.2 |
| 7-9 | — | — | 48.3 | 1.7 | 56.7 | 1.2 |
| 7-10 | — | — | 44.8 | 1.6 | 63.3 | 1.3 |
| Average | — | — | 46.0 | 1.7 | 57.2 | 1.2 |

EXAMPLE 7

The Distribution of Copper in the Infiltrated Metal Part

Infiltrated samples designated 6-4 and 7-4 as described in Example 2 above, were analyzed for copper content at a depth of 0.025 of an inch from the top and bottom surfaces. The top and bottom copper levels for sample 6-4 were 13.2 weight % and 12.8 weight %, respectively. The top and bottom copper levels for sample 7-4 were 11.0 weight % and 11.0 weight %, respectively. Thus a generally uniform distribution of copper throughout the infiltrated powder metal part was attained.

EXAMPLE 8

Infiltration to Intermediate and Maximum Levels

The procedures of Examples 1 through 5 were repeated with a wire alloy comprising 91.6% copper, 1.9% iron, 2.6%, manganese and 3.9% zinc, except that higher levels of infiltrant were used to determine the upper level of infiltration possible with the novel wire alloy. Infiltration of 14.1% of the alloy proceeded normally, whereas infiltration with as much as 14.3% resulted in some small quantity of copper pooling on the surface of some of the specimens. The properties of the resulting infiltrated compacts corresponding to the material designation MPIF FX-1008 are provided in Tables VIII, IX, and X, below.

TABLE VIII

| Sample I.D. | % Infiltrate | Green-Infiltrated Density g/cm$^3$ | Transverse Rupture Strength Psi | Transverse Rupture Strength SI* | Hardness Top/Bottom HRC/HRB |
|---|---|---|---|---|---|
| 6-16 | 10.9 | 6.76-7.40 | 192,100 | 1.84 | 97/93 |
| 6-17 | 10.9 | 6.75-7.39 | 185,700 | 1.78 | 90/91 |
| 6-18 | 10.9 | 6.75-7.39 | 182,800 | 1.81 | 91/91 |
| 6-19 | 10.9 | 6.74-7.39 | 189.500 | 1.82 | 92/92 |
| 6-20 | 10.9 | 6.75-7.38 | 182,600 | 1.75 | 92/90 |
| Average | 10.9 | 6.75-7.39 | 187,000 | 1.81 | 92/91 |
| 6-21 | 14.1 | 6.7-7.63 | 201,400 | 0.65 | 26/96 |
| 6-22 | 14.1 | 6.7-7.61 | 184,000 | 0.60 | 28/97 |
| 6-23 | 14.1 | 6.7-7.61 | 194,100 | 0.63 | 29/96 |
| 6-24 | 14.1 | 6.7-7.60 | 199,200 | 0.65 | 28/95 |
| 6-25 | 14.1 | 6.7-7.61 | 193,900 | 0.63 | 28/95 |
| Average | 14.1 | 6.7-7.61 | 194,600 | 0.63 | 28/96 |
| 7-16 | 10.8 | 6.95-7.59 | 202,600 | 1.96 | 29/96 |
| 7-17 | 10.8 | 6.95-7.62 | 199,700 | 1.93 | 28/95 |
| 7-18 | 10.8 | 6.95-7.65 | 211,800 | 2.04 | 28/95 |
| 7-19 | 10.8 | 6.95-7.65 | 214,800 | 2.06 | 28/95 |
| 7-20 | 10.8 | 6.95-7.66 | 204,200 | 1.96 | 27/97 |
| Average | 10.8 | 6.95-7.63 | 206,600 | 1.99 | 28/96 |
| 7-21 | 13.6 | 6.95-7.73 | 227,200 | 0.86 | 32/24 |
| 7-22 | 13.6 | 6.95-7.69 | 206,600 | 0.79 | 3225 |
| 7-23 | 13.6 | 6.95-7.81 | 210,300 | 0.79 | 32/24 |
| 7-24 | 13.6 | 6.95-7.82 | 213,100 | 0.80 | 32/24 |
| 7-25 | 13.6 | 6.95-7.72 | 223,600 | 0.85 | 32/24 |
| Average | 13.6 | 6.95-7.75 | 216,200 | 0.82 | 32/24 |

TABLE IX

| Sample ID | % Infiltrant | Green-Infiltrated Density g/cm$^3$ | Tensile Strength Psi | Tensile Strength SI* | Yield Strength psi | Yield Strength SI* | % Elongation |
|---|---|---|---|---|---|---|---|
| 6-26 | 10.9 | 6.66-7.30 | 105,000 | 1.02 | 83,600 | 0.81 | 2.0 |
| 6-27 | 10.9 | 6.66-7.28 | 99,500 | 0.97 | 82,800 | 0.81 | 1.5 |
| 6-28 | 10.9 | 6.62-7.27 | 105,000 | 1.02 | 84,100 | 0.82 | 2.5 |
| 6-29 | 10.9 | 6.64-7.27 | 104,000 | 1.01 | 86,400 | 0.84 | 1.0 |
| 6-30 | 10.9 | 6.65-7.29 | 107,000 | 1.04 | 93,700 | 0.91 | 5.0 |
| Average | 10.9 | 6.65-7.28 | 104,000 | 1.01 | 86,100 | 0.84 | 2.4 |
| 6-31 | 13.9 | 6.7-7.58 | 121,000 | 0.43 | 89,500 | 0.32 | 1.0 |
| 6-32 | 13.9 | 6.7-7.61 | 124,000 | 0.44 | 92,500 | 0.33 | 1.0 |
| 6-33 | 13.9 | 6.7-7.62 | 120,000 | 0.42 | 91,000 | 0.32 | 1.5 |
| 6-34 | 13.9 | 6.7-7.56 | 118,000 | 0.42 | 90,500 | 0.32 | 1.5 |
| 6-35 | 13.9 | 6.7-7.53 | 120,000 | 0.43 | 91,000 | 0.33 | 1.3 |
| Average | 13.9 | 6.77-7.58 | 120,000 | 0.42 | 91,000 | 0.32 | 1.3 |
| 7-26 | 10.9 | 6.95-7.72 | 120,000 | 1.10 | 95,000 | 0.87 | 1.0 |
| 7-27 | 10.9 | 6.95-7.72 | 124,000 | 1.14 | 100,000 | 0.92 | 1.5 |
| 7-28 | 10.9 | 6.95-7.71 | 126,000 | 1.16 | 96,000 | 0.88 | 1.5 |
| 7-29 | 10.9 | 6.95-7.74 | 124,000 | 1.14 | 96,000 | 0.89 | 1.5 |
| 7-30 | 10.9 | 6.95-7.70 | 122,000 | 1.12 | 93,500 | 0.86 | 1.0 |
| Average | 10.9 | 6.95-7.72 | 123,000 | 1.13 | 96,000 | 0.88 | 1.3 |
| 7-31 | 14.3 | 6.95-7.90 | 122,000 | 0.37 | 93,500 | 0.28 | 1.5 |
| 7-32 | 14.3 | 6.95-7.85 | 124,000 | 0.38 | 97,500 | 0.28 | 1.5 |
| 7-33 | 14.3 | 6.95-7.90 | 126,000 | 0.38 | 110,000 | 0.33 | 1.0 |
| 7-34 | 14.3 | 6.95-7.87 | 121,000 | 0.37 | 95,000 | 0.29 | 1.0 |
| 7-35 | 14.3 | 6.95-7.81 | 120,000 | 0.37 | 94,000 | 0.29 | 1.0 |
| Average | 14.3 | 6.95-7.87 | 123,000 | 0.37 | 98,000 | 0.30 | 1.2 |

TABLE X

| Sample I.D. | % Infiltrant | Green-Infiltrated Density g/cm$^3$ | Impact Energy Ft-lbf |
|---|---|---|---|
| 6-36 | 10.9 | 6.75-7.40 | 15 |
| 6-37 | 10.9 | 6.76-7.42 | 15 |
| 6-38 | 10.9 | 6.73-7.39 | 14 |
| 6-39 | 10.9 | 6.74-7.41 | 14 |
| 6-40 | 10.9 | 6.77-7.42 | 14.5 |
| Average | 10.9 | 6.75-7.41 | 14.5 |
| 6-41 | 14.1 | 6.7-7.57 | 9.0 |
| 6-42 | 14.1 | 6.7-7.57 | 12.0 |
| 6-43 | 14.1 | 6.7-7.60 | 11.5 |
| 6-44 | 14.1 | 6.7-7.60 | 10.5 |
| 6-45 | 14.1 | 6.7-7.58 | 11.5 |
| Average | 14.1 | 6.7-7.59 | 11.0 |
| 7-36 | 10.7 | 6.95-7.60 | 12.5 |
| 7-37 | 10.7 | 6.95-7.61 | 12.5 |
| 7-38 | 10.7 | 6.95-7.60 | 15.0 |
| 7-39 | 10.7 | 6.95-7.59 | 13.5 |
| 7-40 | 10.7 | 6.95-7.61 | 10.5 |
| Average | 10.7 | 6.95-7.60 | 13.0 |
| 7-41 | 13.8 | 6.95-7.79 | 14.5 |
| 7-42 | 13.8 | 6.95-7.78 | 10.0 |
| 7-43 | 13.8 | 6.95-7.78 | 8.5 |
| 7-44 | 13.8 | 6.95-7.74 | 14.0 |
| 7-45 | 13.8 | 6.95-7.67 | 10.0 |
| Average | 13.8 | 6.95-7.77 | 11.0 |

EXAMPLE 9

Infiltration with a Powder Alloy Compact

The procedures of Example 8 were repeated with a powdered alloy XF-5, (available from U.S. Bronze, 18649 Brake Shoe Road, Meadville, Pa.) that comprised 94.1% copper, 1.7% iron, 2.8% manganese, and 1.4% zinc to form infiltrated compacts corresponding to the material designation MPIF FX-1008. The results obtained are provided in Tables XII, XIII, and XIV, provided below.

TABLE XII

| Sample | % | Green-Infiltrated Density | Tensile Strength | | Yield Strength | | % Elon-ga- |
|---|---|---|---|---|---|---|---|
| I.D. | Infiltrant | g/cm$^3$ | Psi | SI* | psi | SI* | tion |
| 6-31 | 13.5 | 6.7-7.36 | 120,000 | 0.49 | 90,000 | 0.37 | 1.0 |
| 6-32 | 13.5 | 6.7-7.40 | 118,000 | 0.48 | 90,000 | 0.37 | 1.0 |

TABLE XII-continued

| Sample | % | Green-Infiltrated Density | Tensile Strength | | Yield Strength | | % Elon-ga- |
|---|---|---|---|---|---|---|---|
| I.D. | Infiltrant | g/cm$^3$ | Psi | SI* | psi | SI* | tion |
| 6-33 | 13.5 | 6.7-7.44 | 118,000 | 0.48 | 90,000 | 0.36 | 1.0 |
| 6-34 | 13.5 | 6.7-7.34 | 119,000 | 0.49 | 94,000 | 0.39 | 1.0 |
| 6-35 | 13.5 | 6.7-7.34 | 111,000 | 0.46 | 88,500 | 0.36 | 1.0 |
| Average | 13.5 | 6.7-7.38 | 117,000 | 0.48 | 90,500 | 0.37 | 1.0 |

TABLE XIII

| Sample I.D. | % Infiltrant | Green-Infiltrated Density g/cm$^3$ | Impact Energy ft-lbf |
|---|---|---|---|
| 6-36 | 13.5 | 6.7-7.47 | 10.5 |
| 6-37 | 13.5 | 6.7-7.48 | 11.5 |
| 6-38 | 13.5 | 6.7-7.50 | 11.0 |
| 6-39 | 13.5 | 6.7-7.48 | 14.0 |
| 6-40 | 13.5 | 6.7-7.51 | 14.5 |
| Average | 13.5 | 6.7-7.49 | 12.3 |

TABLE XIV

| Sample | % | Green-Infiltrated | Transverse Rupture Strength | | Hardness Top/Bottom |
|---|---|---|---|---|---|
| I.D. | Infiltrant | Density g/cm$^3$ | psi | SI* | HRC/HRB |
| 6-41 | 13.5 | 6.7-7.49 | 193,300 | 0.78 | 25/95 |
| 6-42 | 13.5 | 6.7-7.48 | 195,600 | 0.79 | 23/95 |
| 6-43 | 13.5 | 6.7-7.56 | 186,800 | 0.74 | 25/95 |
| 6-44 | 13.5 | 6.7-7.54 | 182,000 | 0.73 | 25/95 |
| 6-45 | 13.5 | 6.7-7.55 | 186,200 | 0.75 | 25/95 |
| Average | 13.5 | 6.7-7.52 | 188,800 | 0.76 | 25/95 |

Table XV, provided below, summarizes the data averages from tables III through XIV. Articles infiltrated with in the order of 10-11% of the wire infiltrate have transverse rupture strengths, tensile strengths and yield strengths substantially greater than articles infiltrated with as much as 13.5% of a powder infiltrant. Even as the strength measurements coalesce at full or nearly complete infiltration, the wire infiltrant typically provides a greater measure of strength than the powder infiltrant.

TABLE XV

| Run | % Infiltrant | Green/infiltrated density | TRS | TRS-SI* | TS | TS-SI* | YS | YS-SI* |
|---|---|---|---|---|---|---|---|---|
| 6-2/6-5 | 14.6 | 6.67/7.59 | 215,000 | 0.64 | | | | |
| 6-21/6-25 | 14.1 | 6.7/7.61 | 194,600 | 0.63 | | | | |
| 6-16/6-20 | 10.9 | 6.75/7.39 | 187,000 | 1.81 | | | | |
| 6-41/6-45 | 13.5* | 6.7/7.52 | 188,800 | 0.76 | | | | |
| 7-21/7-25 | 13.6 | 6.95/7.75 | 216,200 | 0.82 | | | | |
| 7-1/7-4 | 13.4 | 6.96/7.81 | 219,000 | 0.87 | | | | |
| 7-16/7-20 | 10.8 | 6.95/7.63 | 206,600 | 1.99 | | | | |
| 7-16/7-20 | 10.8 | 6.95/7.63 | 206,600 | 1.99 | | | | |
| 6-31/6-35 | 13.9 | 6.77/7.58 | | | 120,000 | 0.42 | 91,000 | 0.32 |
| 6-6/6-10 | 12.1 | 6.7/7.44 | | | 114,000 | 0.72 | 86,500 | 0.54 |
| 6-26/6-30 | 10.9 | 6.65/7.28 | | | 104,000 | 1.10 | 86,100 | 0.84 |
| 6-31/6-35 | 13.5* | 6.7/7.38 | | | 117,000 | 0.48 | 90,500 | 0.37 |
| 7-31/7-35 | 14.3 | 6.95/7.87 | | | 123,000 | 0.37 | 98,000 | 0.30 |
| 7-6/7-10 | 11.4 | 7.0/7.66 | | | 127,000 | 0.98 | 94,300 | 0.73 |
| 7-26/7-30 | 10.9 | 6.95/7.72 | | | 123,000 | 1.13 | 96,000 | 0.88 |

*Powder infiltrant was used rather than the wire alloy infiltrant

Table XVI, provided below summarizes selected data from tables VIII through XIV. This summarized data illustrates the ability of lower levels of the wire alloy infiltrant to: a) provide equal or superior mechanical properties, b) more efficiently infiltrate to achieve higher density infiltrated compacts, and (c) reduce the infiltrated compact's cost by reducing the amount of infiltrate required. The ability to achieve superior mechanical properties by infiltrating a higher density green compact with a lesser quantity of wrought alloy infiltrant (24-26% less) can provide significant cost savings.

TABLE XVI

| | Wire Alloy | Wire Alloy | XF-5 Powder Alloy |
|---|---|---|---|
| Green Density, g/cm$^3$ | from 6.65 to 6.75 | 6.95 | 6.7 |
| Infiltrated Density, g/cm$^3$ | 7.28-7.41 | 7.60-7.72 | 7.38-7.52 |
| % Infiltration | 10.9 | 10.7-10.9% | 13.5% |
| Relative Amount of Infiltrant | 1 | 1 | 1.24-1.26 |
| Tensile Strength, psi | 104,000* | 123,000 | 117,000 |
| Yield Strength, psi | 86,100* | 96,000 | 90,500 |
| Transverse Rupture Strength, psi | 187,000** | 206,600 | 188,800 |
| Impact Energy, Ft-lbf | 14.5** | 13.5 | 12.3 |
| % Elongation | 2.4* | 1.3 | 1.0 |
| Hardness Top/Bottom, HRC/HRB | 92/91** | 28/96 | 28/95 |

*data for 6.65 g/cm$^3$ green density
**data for 6.75 g/cm$^3$ green density

EXAMPLE 10

Preparation of Novel Copper Infiltration Alloy

A mixture containing 92 parts by weight copper, 3 parts by weight manganese, 3 parts by weight zinc and 2 parts by weight iron was heated to about 2100° F. to form a homogeneous melt. The molten mass was transferred into a mold, heat was removed and the billet formed was removed from the mold. The billet was superheated and extruded to form rods having a cross sectional diameter of about one fourth of an inch. In a similar manner the billet can be extruded to form tubes or rolled to form sheets. The rods formed were drawn into a wire having a diameter of about 0.093 inches. Similarly, the rods formed can be rolled to form sheets of the alloy. Infiltrants having disk and washer shapes can be formed from rods and tubes having a range of diameters by cutting the rods and tubes across their longitudinal axis. Infiltrants having a wafer shape can be formed from the alloy in sheet form or by cutting sections of rods having a square, rectangular or other cross-sectional shape. Infiltrants having a ring or torus shape can be formed from wire forms of the alloy. Wire forms of the alloy can be wound onto spools and the like to simplify transportation, storage and handling. Because the wires have a generally uniform density, the weight of infiltrant can be conveniently related to the length of a section of wire or ribbon.

Copper alloys having as little as about 85 weight % copper, about 0.5 to about 5.5 weight % manganese, about 0.5 to about 5.5 weight % zinc and about 0.5 to about 3.5 weight % iron can be prepared according to this method and formed into the various forms of wrought infiltrant articles discussed above. Such articles are particularly suitable for providing infiltrated powder metal parts having superior physical properties.

EXAMPLE 11

Chemical Analysis of XF-5 Powder Infiltrant and the Wire Alloy Infiltrant

Samples of the XF-5 powder infiltrant available from U.S. Bronze and the wire alloy infiltrant (described in Example 8) of the present disclosure were subjected to bulk analysis. Trace elements and minor impurities were not determined. The results are provided in Table XVII.

TABLE XVII

Bulk Analysis of Powder and Wire Alloy Infiltrates

| Element | XF-5 Powder | Wire Alloy |
|---|---|---|
| Mn | 2.8 | 2.6 |
| Fe | 1.7 | 1.9 |
| Zn | 1.4 | 3.9 |

EXAMPLE 12

Distribution of Metals in XF-5 Powder and Wire Alloy

A portion of the XF-5 Powder was dispersed in an epoxy and cast into a sample mold to form a composite sample. The composite's cross section was polished to expose the cross-section of individual powder particles. The wire alloy was cross-sectioned and mounted to examine its longitudinal direction (the wire drawn direction). Cross sections of the powder composite and wire were examined by SEM-EDS analysis.

Figure 5:
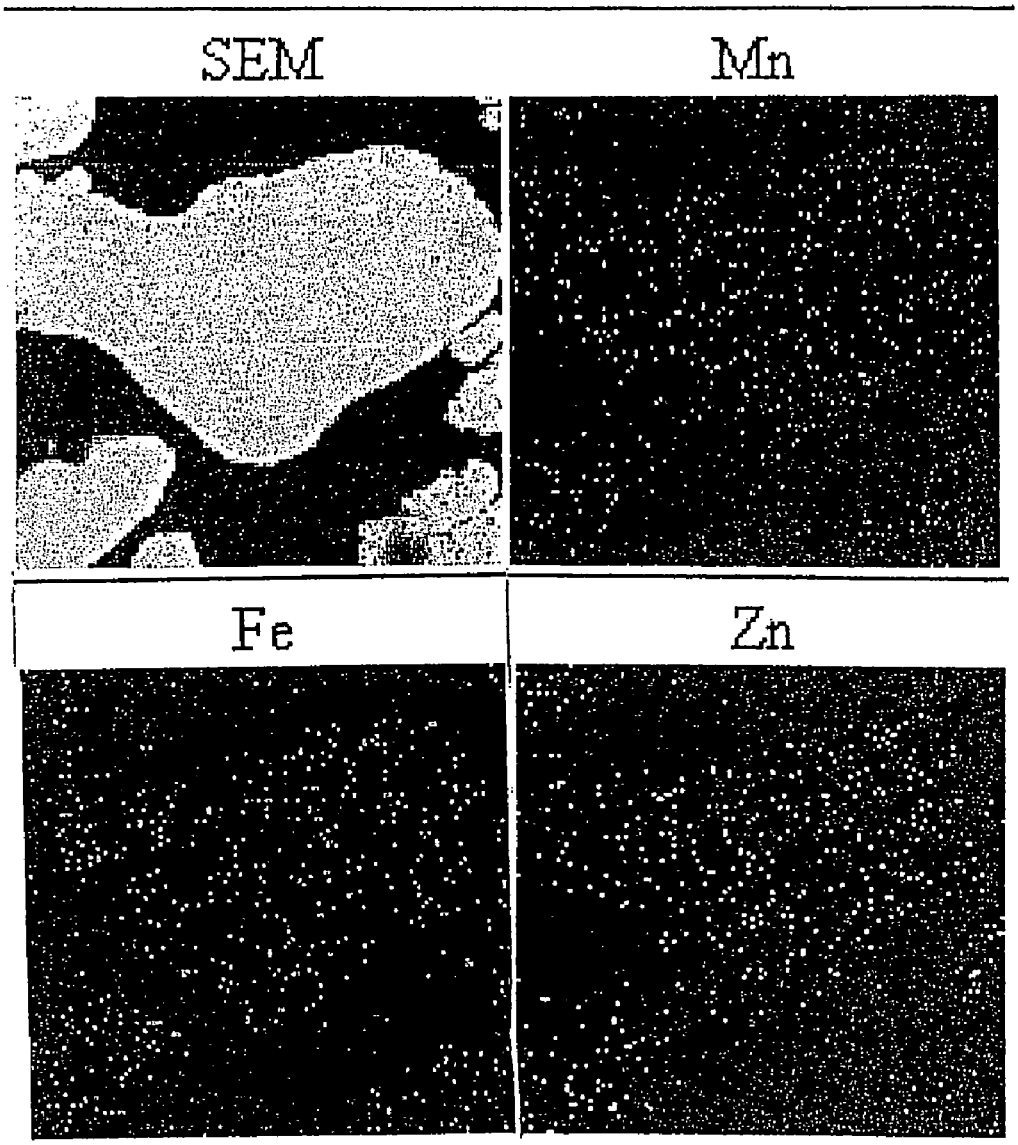
FIG. 5 shows the image of an XF-5 powder particle in cross section and dot maps for Mn, Fe and Zn derived from a SEM-EDS analysis.
Figure 6:
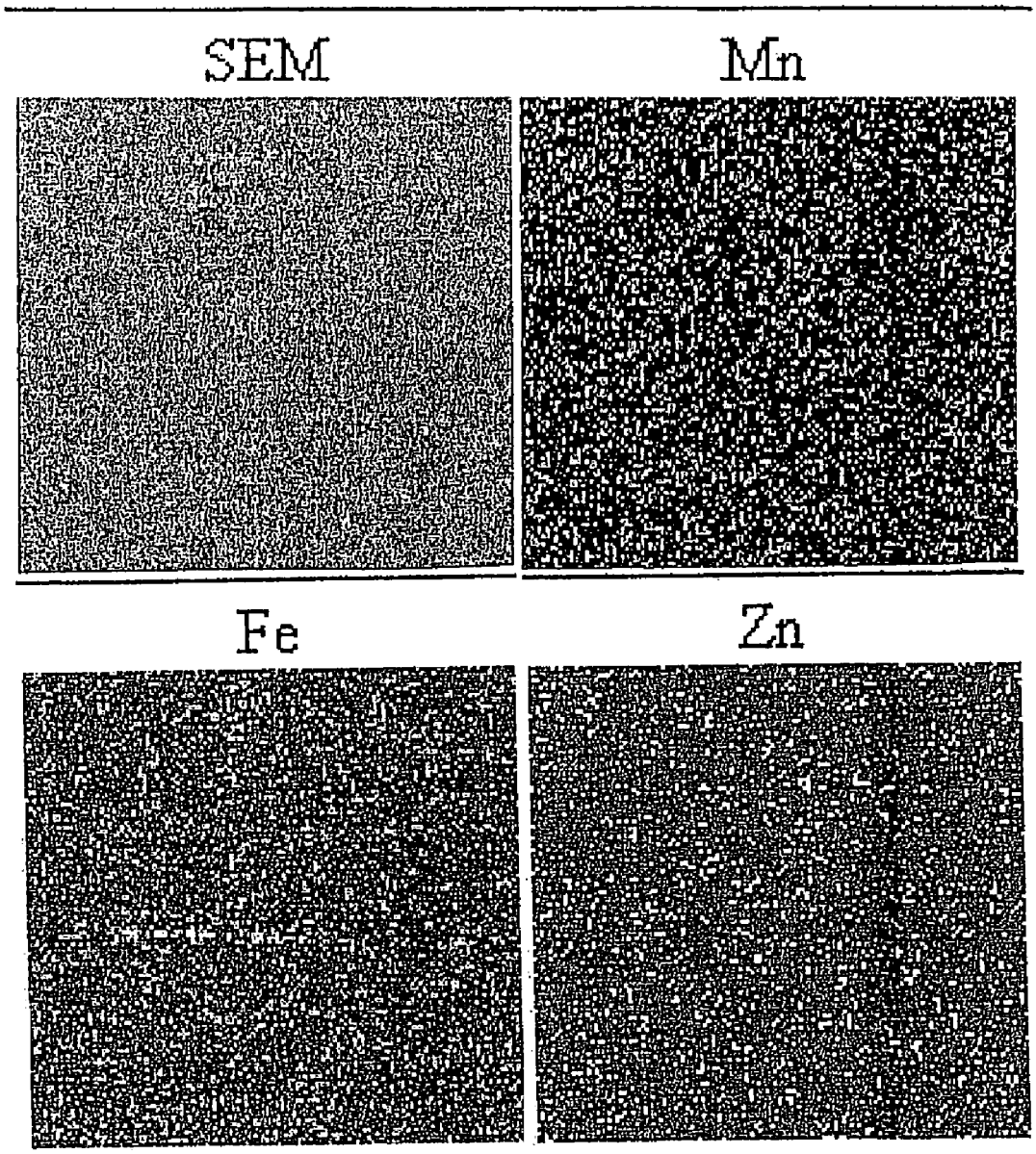
FIG. 6 shows the image of the wire alloy in cross section and dot maps for Mn, Fe and Zn derived from a SEM-EDS analysis.

FIG. 5 shows the powder particle composite in cross-section and dot maps of the elements Mn, Fe, and Zn. The number and distribution of dots represents the amount of a metal element present and its distribution through the particle. FIG. 6 shows the wire alloy cross-section and dot maps. A greater number of dots present represents a higher metal content and the even distribution of dots represents an even distribution of the metal elements throughout the wire alloy. FIGS. 5 and 6 indicate that the powder contains lesser amounts of the metals evenly distributed throughout the powder whereas the wire contains a large metal content evenly distributed throughout the wire's cross-section.

EXAMPLE 13

Evidence of Un-Alloyed Fe in the Non-Homogeneous XF-5 Powder

A small magnet was placed in a sample of the XF-5 powder infiltrant. Upon removing the magnet the tip was observed to be coated with fine grey particles aligned with the magnetic field of the magnet's tip indicating the presence of unalloyed iron particles in the XF-5 powder.

EXAMPLE 14

The Elemental Analysis Spectrum of the XF-5 Powder and the Wire Alloy

Figure 7:
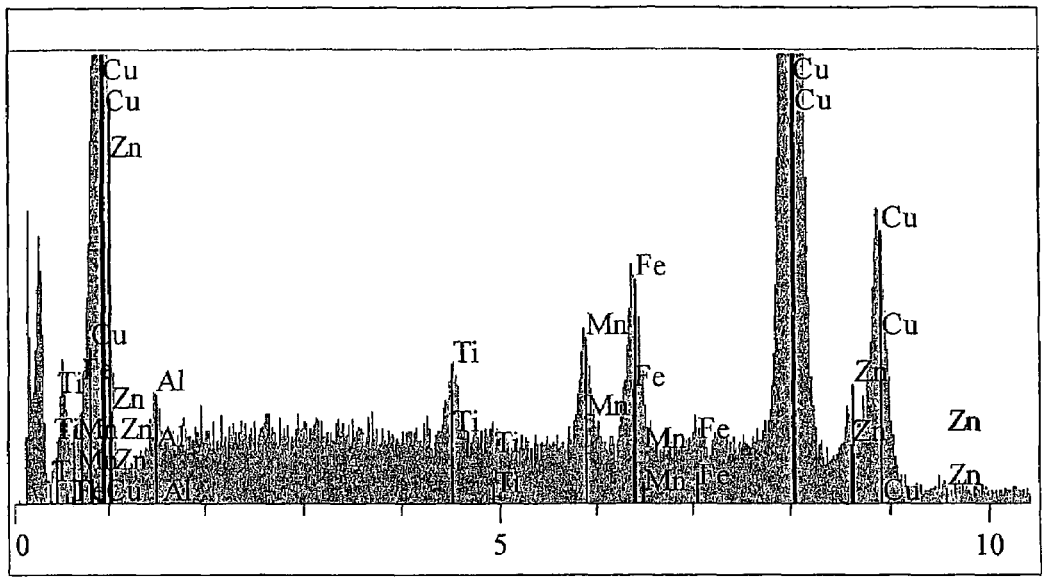
FIG. 7 provides an SEM-EDS elemental analysis of the XF-5 powder.

The elemental analysis spectrum of a sample of the bulk XF-5 powder was measured and the results provided in FIG. 7. The presence of trace amounts of aluminum and titanium was noted. As expected, the copper is shown to be the major component. However, the iron levels appear to be slightly higher than the manganese levels, which is inconsistent with the bulk analysis provided in Example 11. Although inconsistent with the bulk analysis, the result is consistent with the powder infiltrant being a mixture of individual powder particles that can segregate and, depending on sampling and particle distribution, demonstrate variable composition from sample to sample.

Figure 8:
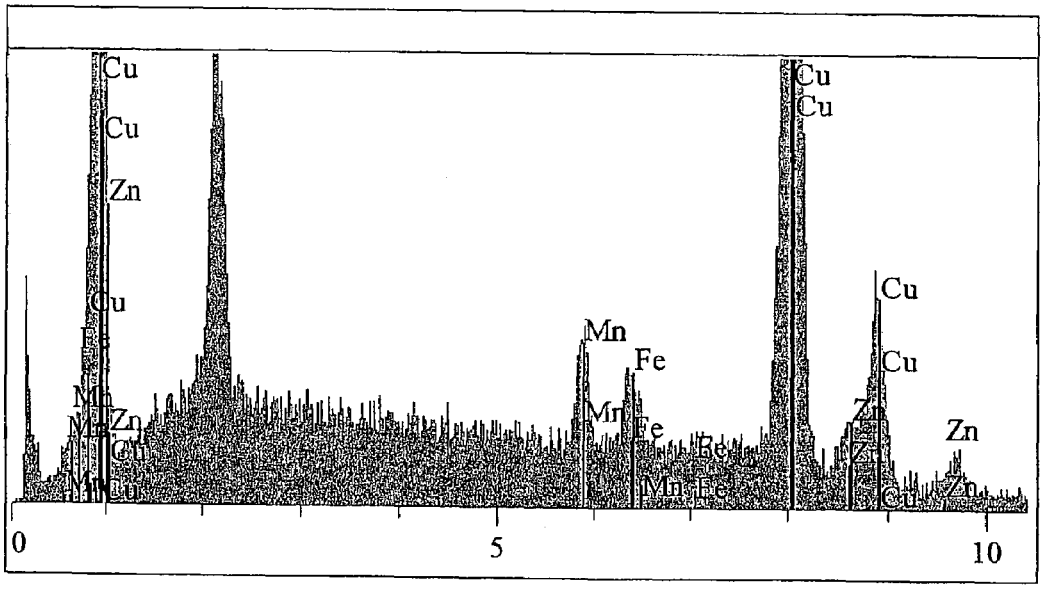
FIG. 8 provides an SEM-EDS elemental analysis of the wire alloy.

The elemental analysis spectrum of the wire alloy was similarly measured and the results provided in FIG. 8. The large unmarked peak to the left of FIG. 8 is gold, which was sputter-coated onto the wire alloy sample to ensure adequate conductivity. Like the powder, copper peaks are the largest, copper making up more than 90% of the alloy. Unlike the powder, the manganese peak is higher than the iron peak, consistent with the bulk analysis. The elemental analysis of the wire alloy is consistent with the wire alloy having a generally uniform composition.

EXAMPLE 15

Elemental Analysis of Individual XF-5 Powder Particles

Figure 9:
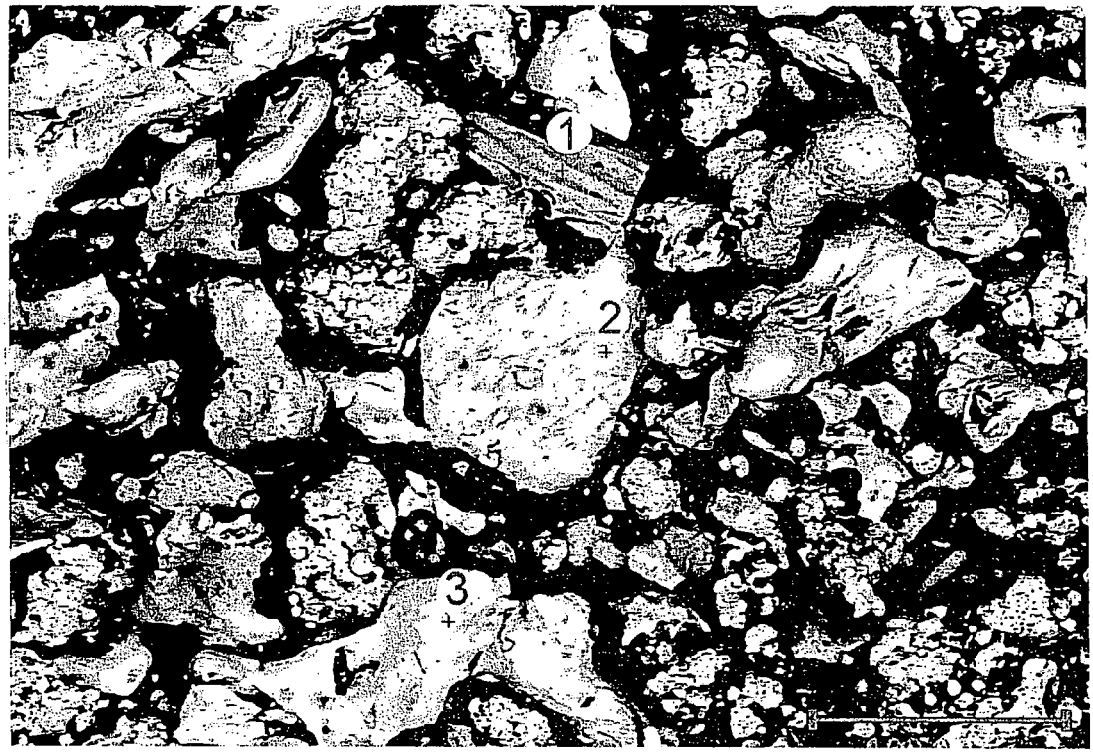
FIG. 9 provides an SEM photo of loose particles of the XF-5 powder at a 250× magnification with particle No.'s 1, 2, and 3 designated for further analysis.
Figure 10:
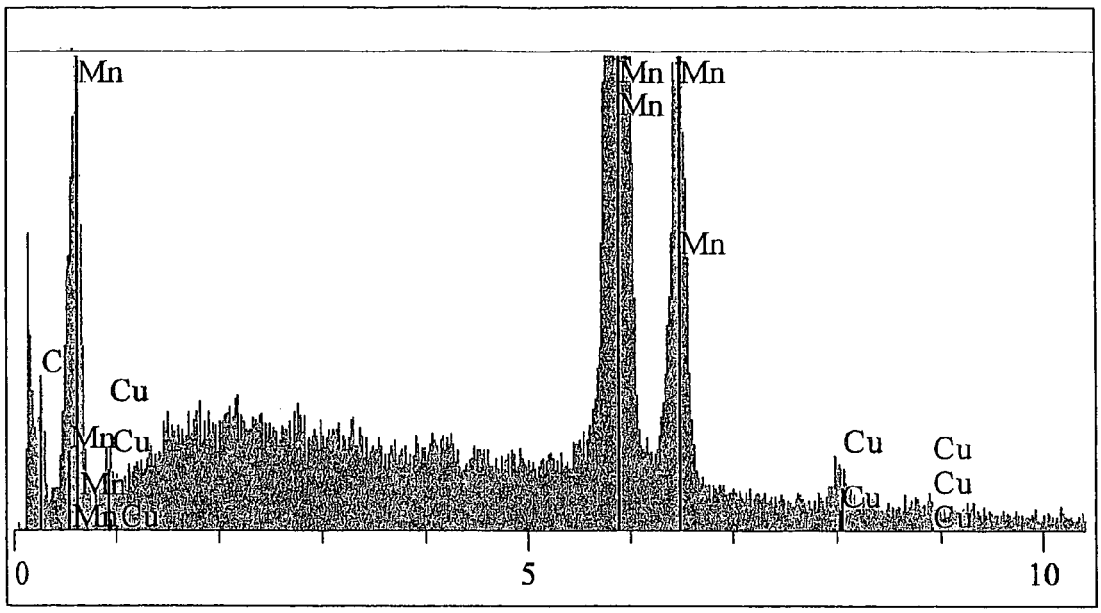
FIG. 10 provides an SEM-EDS elemental analysis of particle No. 1 from FIG. 9.
Figure 11:
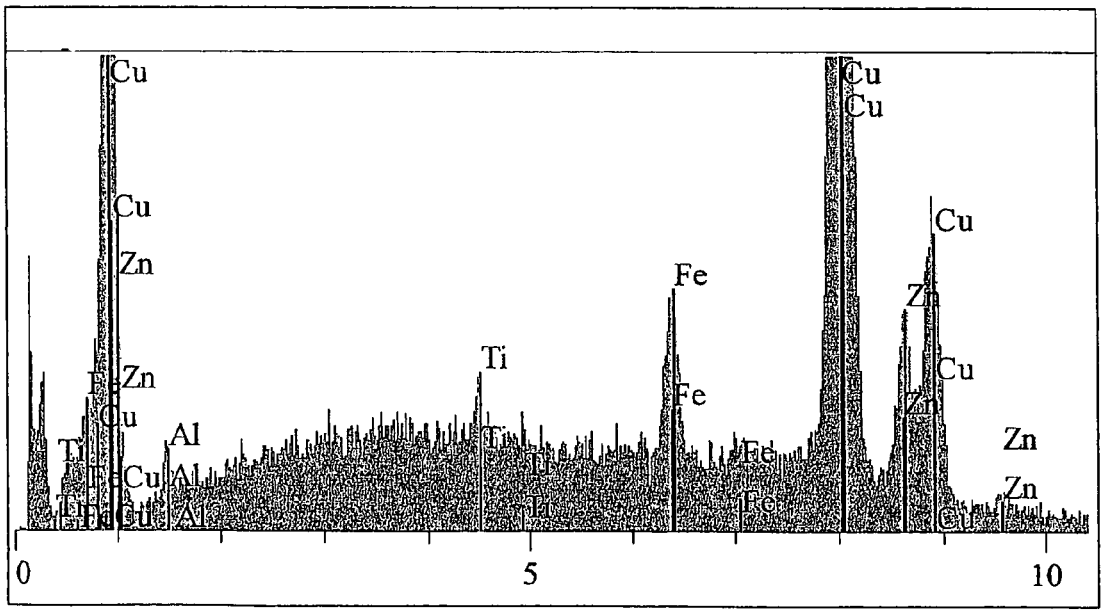
FIG. 11 provides an SEM-EDS elemental analysis of particle No. 2 from FIG. 9.
Figure 12:
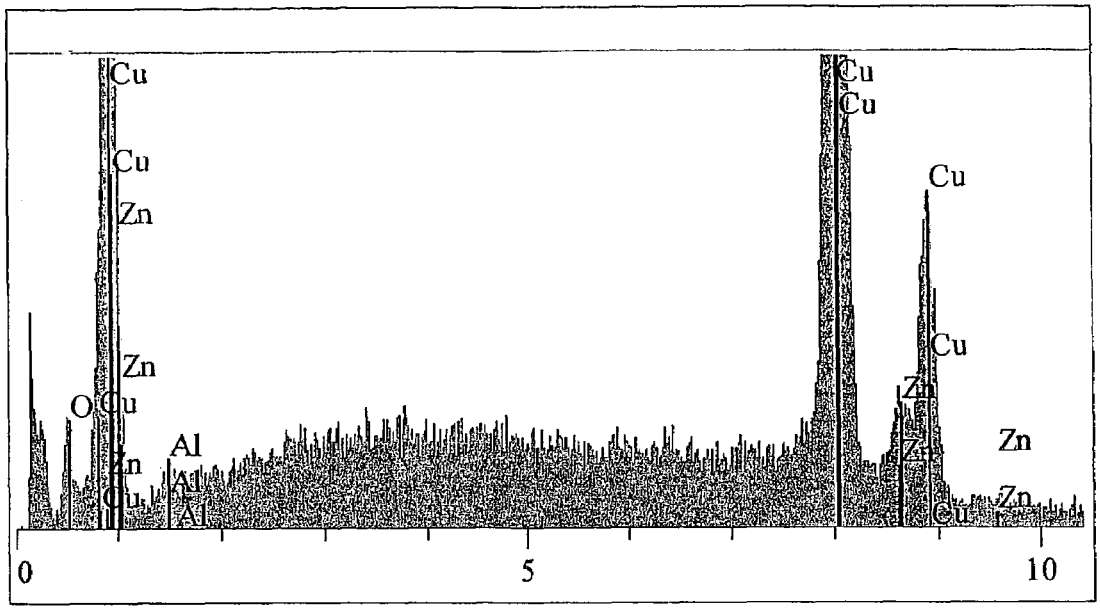
FIG. 12 provides an SEM-EDS elemental analysis of particle No. 3 from FIG. 9.

FIG. 9 shows a distribution of the XF-5 powder particles at 250× magnification. Individually selected particles designated by numerals 1, 2, and 3 are noted. The individual elemental spectra for particles 1, 2, and 3 were measured and are provided in FIGS. 10, 11, and 12, respectively. As is evident from FIG. 10, particle 1 is a substantially pure particle of manganese. The small copper peaks are background readings from larger nearby copper particles. As can be noted from FIG. 11, particle 2 appears to be a brass particle having an approximately 10% zinc content and minor amounts of titanium and iron impurities. The spectrum of particle 3, shown in FIG. 12 indicates that particle 3 is a nearly pure particle of copper. Based on the magnetic study (Example 13), the elemental analysis (Example 14) and the analysis of individual XF-5 particles (this Example), the XF-5 powder is a non-homogeneous mixture of copper, a copper/zinc brass alloy, iron, and manganese. In contrast, all of the spectral evidence provided indicates that the wire alloy is a substantially homogeneous alloy comprising copper, iron, zinc and manganese.

While the disclosure has been illustrated and described in detail in the foregoing description and examples, the same is considered to be illustrative and not restrictive in character, it is understood that only the preferred embodiments have been shown and described and that all changes and modifications that come within the spirit of the disclosure are desired to be protected.

I claim:

1. A method for infiltrating a powder metal part, the method comprising:

a) selecting the powder metal part;

b) selecting a copper alloy having a wrought form adapted to contact a surface of the powder metal part, wherein the alloy comprises: (i) at least about 85 weight % copper, ii) about 0.5 to about 3.5 weight % iron, iii) about 0.5 to about 5.5 weight % manganese, and iv) about 0.5 to about 5.5 weight % zinc;

c) contacting the alloy with a surface of the powder metal part; and d) heating the alloy and the powder metal part to a temperature sufficient to cause the alloy to melt and infiltrate the powder metal part.

2. The method of claim 1, wherein the alloy contains at least about 90 weight % copper.

3. The method of claim 1, wherein the powder metal part is an iron-based powder metal part.

4. The method of claim 3, wherein the powder metal part is a sintered metal part.

5. The method of claim 1, wherein the surface of the powder metal part is an upper surface.

6. The method of claim 1, wherein the temperature is at least about 800° C.

7. The method of claim 1, wherein the wrought form is a wire segment.

8. The method of claim 7, wherein the wire segment has a generally torus shaped form.

9. The method of claim 1, wherein the wrought form is a disk.

10. The method of claim 1, wherein the wrought form is a washer.

11. The method of claim 1, wherein the heating is conducted at less than atmospheric pressure.

12. The method of claim 1, wherein the heating is conducted in a highly-reducing atmosphere.

13. The method of claim 1, wherein the wrought form is a wafer.

* * * * *